United States Patent [19]

Yoneda et al.

[11] Patent Number: 5,042,620

[45] Date of Patent: Aug. 27, 1991

[54] ELEVATOR CONTROL SYSTEM

[75] Inventors: Kenzi Yoneda, Katsuta; Yoshio Sakai, Naka; Hiroshi Matsumaru; Toshimitsu Tobita, both of Katsuta; Seiji Yasunobu, Yokohama, all of Japan

[73] Assignee: Hitachi, Ltd., Tokyo, Japan

[21] Appl. No.: 406,290

[22] Filed: Sep. 12, 1989

[30] Foreign Application Priority Data

Sep. 20, 1988 [JP] Japan ..... 63-233432

[51] Int. Cl.[5] ..... B66B 1/18

[52] U.S. Cl. ..... 187/124; 187/130

[58] Field of Search ..... 187/121, 124, 135, 136, 187/138, 139, 103, 130

[56] References Cited

U.S. PATENT DOCUMENTS 4,832,158 5/1989 Farrar et al. ..... 187/103
4,852,696 8/1989 Fukuda et al. ..... 187/139
4,872,532 10/1989 Tobita et al. ..... 187/121

*Primary Examiner*—A. D. Pellinen
*Assistant Examiner*—W. E. Duncanson, Jr.
*Attorney, Agent, or Firm*—Antonelli, Terry, Stout & Kraus

[57] ABSTRACT

A control system for an elevator has a plurality of elevator information generation devices each of which has an information output unit which outputs elevator information to an elevator controller and also to at least one display controller which generates one or more on elevator displays. There are a plurality of display controllers, these are preferably connected to the information output units by a common transmission path. There may be a plurality of elevator controllers, when there are a plurality of elevator cabs, and those elevator controllers may all be connected to the common transmission path. There is then a supervisor controller for controlling the elevator controllers.

14 Claims, 17 Drawing Sheets

FIG. 3

CMTBL (CAB DATA TABLE)

| |
|---|
| CACD (DRIVE MODE NUMBER) |
| CTCD (TROUBLE SHOOTING NUMBER) |
| CPSI (CAB POISITION) |
| CFPI (LEADER CAB POSITION) |
| CSPD (CAB SPEED) |
| CCLTM (DOOR CLOSE COMPLETION PRESUMPTION TIME) |
| CWG (PASSENGER NUMBER INSIDE CAB) |
| CC (CAB CALL) |
| COPN (OPEN INSTRUCTION) |
| CCLS (CLOSE INSTRUCTION) |
| CDIR (OPERATION DIRECTION) |
| HC (HALL CALL) |
| CPH (PHOTOELECTRIC DEVICE) |
| COPLS (DOOR OPEN LIMIT SWITCH) |
| CCLLS (DOOR CLOSE LIMIT SWITCH) |

MTBL (CONTROL DATA TABLE)

| |
|---|
| MACD (CONTROL DRIVE MODE NUMBER) |
| MTCD (TROUBLE CODE NUMBER) |
| MTRFCD (TRAFFIC DEMAND MODE) |

MCTBL (CONTROL INSTRUCTION DATA TABLE)

| |
|---|
| KDH (ASSIGNED HALL CALL) |
| KDC (ASSIGNED CAB CALL) |
| KOPE (OPEN BUTTON ACTIVE) |
| KCLE (CIOSE BUTTON ACTIVE) |
| KSTE (DEPARTURE PERMIT) |
| KFPI (FLOATING CAB POSITION) |
| KSVF (SERVICE FLOOR TABLE BASED ON REVERSE PRESUMING CONTROL) |

FIG. 4

CSTBL (DRIVE INFORMATION DATA TABLE)

| |
|---|
| CDRP (DOOR OPEN-STAY BUTTON) |
| COPN (DOOR OPEN BUTTON) |
| CSHW (SAFETY SHOW) |
| CINPP (INSTEPPING PASSENGER NUMBER) |
| COUTP (OUTSTEPPING PASSENGER NUMBER) |
| CINMP (INSTEP DETECTION) |

MSTBL (SERVICE DATA TABLE)

| |
|---|
| KLITM (WAITING LONG SIGNAL) |
| KPSN (INSTEP PASSENGER PRESUMPTION NUMBER) |
| MWTP (WAITING TIME RECKONING PARAMETER) |
| HSTOP (PRESUPPOSED STOPPING TIME) |
| |

FIG. 5

UCTBL (USER COMMAND TABLE)

| |
|---|
| UPITM (SPECIAL RUN NO. 1 TIME) |
| USVF (SERVICE FLOOR) |
| UDRM (DOOR OPEN CLOSE CONTROL MODE) |
| UHSVM (HALL CALL SERVICE MODE) |
| URSTR (DEPARTURE PROMOTION RULE) |
| |

USTBL (GENERAL INFORMATION DATA TABLE)

| |
|---|
| UDTM (TIME AND DATE DATA) |
| US1 (WEATHER FORCAST) |
| US2 (PRESENT WEATHER REPORT) |
| US3 (TRAFFIC INFORMATION) |
| ⋮ |
| UTN (COMMERCIAL ADVERTISEMENTS) |
| UMS (MESSAGES) |
| USRU (INFORMATIONAL GUIDANCE RULE) |
| USDR (PICTURE ELEMENT COLORING DATA) |

| | |
|---|---|
| tn1 | CAB AT 2ND FLOOR, 3 PEOPLE OUTSTEPPING |
| tn2 | CAB AT 2ND FLOOR, 3 PEOPLE INSTEPPING |
| tn3 | CAB AT 2ND FLOOR, DOOR CLOSING |
| tn4 | CAB AT 2ND FLOOR, REVERSING BY SAFETY SHOE |
| tn5 | CAB AT 2ND FLOOR, REVERSING BY OPEN BUTTON, BEING STAYING |

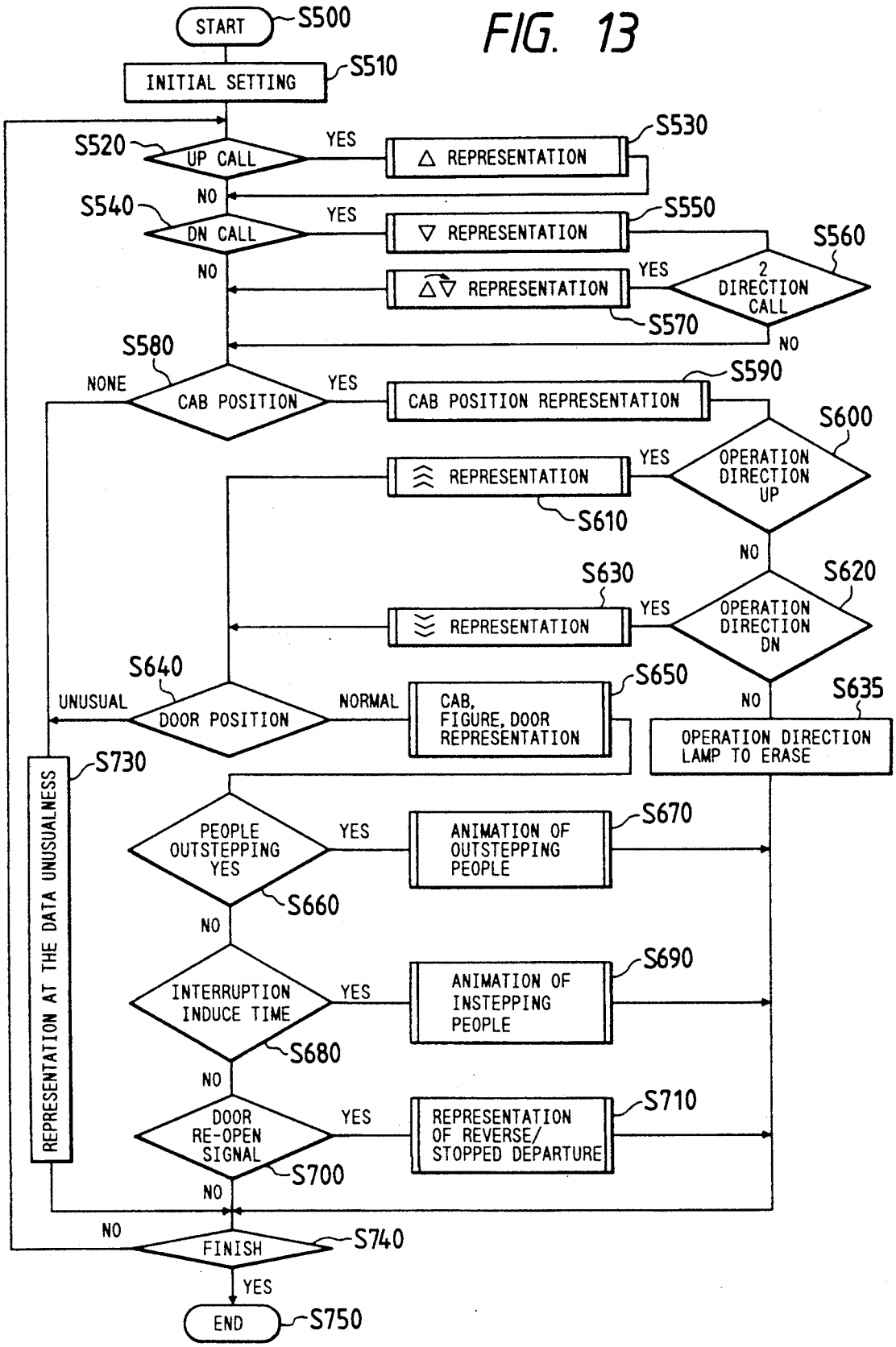
FIG. 13
START
S500
INITIAL SETTING
S510
S520
UP CALL
YES
△ REPRESENTATION
S530
NO
S540
DN CALL
YES
▽ REPRESENTATION
S550
S560
NO
△▽ REPRESENTATION
YES
2 DIRECTION CALL
S570
NO
S580
NONE
CAB POSITION
YES
CAB POSITION REPRESENTATION
S590
S600
REPRESENTATION
YES
OPERATION DIRECTION UP
S610
NO
S630
S620
REPRESENTATION
YES
OPERATION DIRECTION DN
S640
UNUSUAL
DOOR POSITION
NORMAL
CAB, FIGURE, DOOR REPRESENTATION
S650
NO
S635
OPERATION DIRECTION LAMP TO ERASE
S730
REPRESENTATION AT THE DATA UNUSUALNESS
PEOPLE OUTSTEPPING YES
YES
ANIMATION OF OUTSTEPPING PEOPLE
S670
S660
NO
INTERRUPTION INDUCE TIME
YES
ANIMATION OF INSTEPPING PEOPLE
S690
S680
NO
DOOR RE-OPEN SIGNAL
YES
REPRESENTATION OF REVERSE/ STOPPED DEPARTURE
S710
S700
NO
NO
FINISH
S740
YES
END
S750

FIG. 17

TRXMT RSNO CONTROL TABLE

| | |
|---|---|
| NO. 1 | COMMON CONTROL TABLE FOR INPUT-OUTPUT TO AND FROM ALL TERMINALS |
| 2 | CONTROL TABLE SIGNAL OUTPUT FROM CE1 AND SIGNAL TO CE1 FROM M10 |
| 3 | CONTROL TABLE SIGNAL OUTPUT FROM CE2 AND SIGNAL TO CE2 FROM M10 |
| 4 | CONTROL TABLE SIGNAL OUTPUT FROM CE3 AND SIGNAL TO CE3 FROM M10 |
| 9 | CONTROL TABLE SIGNAL OUTPUT FROM CE8 AND SIGNAL TO CE8 FROM M10 |
| 10 | INPUT AND OUTPUT SIGNAL CONTROL FOR USE OF U1 |
| 11 | INPUT AND OUTPUT SIGNAL CONTROL FOR USE OF M10 |
| 12 | INPUT AND OUTPUT SIGNAL CONTROL FOR USE OF SE1 |
| n-2 | INPUT AND OUTPUT CONTROL TABLE FOR USE OF SC1 |
| n-1 | INPUT AND OUTPUT CONTROL TABLE FOR USE OF F1 |
| n | INPUT AND OUTPUT CONTROL TABLE FOR USE OF CS1 |

TRXMT (n, 0 9)

RSNO n BLOCK DATAIL TABLE

| | | | | | | |
|---|---|---|---|---|---|---|
| (0) | TRANSMISSION ADDRESSEE HEADER NUMBER | | | | | |
| (1) | LA TRANSMISSION PATH DESIGNATION | LB TRANSMISSION PATH DESIGNATION | BCC CHECK YES/NO | SIGNAL CHANGE TRANSMISSION | IRQ EN | WAKE UP TIME |
| (2) | TX DATA NUMBER (SENDING DATA) | | | | | |
| (3) | RX DATA NUMBER (RECEIVING DATA) | | | | | |
| (4) | HEAD ADDRESS OF TX TABLE | | | | | |
| (5) | | | | | | |
| (6) | HEAD ADDRESS OF RX TABLE | | | | | |
| (7) | | | | | | |
| (8) | DEVELOPMENT TABLE OF RECEIVING DATA | | | | | |
| (9) | | | | | | |

ELEVATOR CONTROL SYSTEM

BACKGROUND OF THE INVENTION

1. Field of the Invention

The present invention relates to a control system for an elevator.

2. Summary of the Prior Art

The technology of elevator control systems is becoming increasingly complex as attempts are made to provide a more responsive system to the users of the elevator. Thus, JP-A-56-75365 and JP-A-58-104880 discuss devices in which an indication is made when an elevator cab is fully packed with passengers, and therefore will pass and not stop at certain floors. Furthermore, JP-A-57-38277 shows a device which indicates the amount of space within the elevator cab, to inform users how many more passengers can get in. Furthermore, it is common for a device located at the user's floor to indicate the position of the cab in response to a call, such as those described in JP-A-49-1260, JP-A-56-88081, and JP-A-52-126850. It is also possible to indicate at which floors the elevator cab will stop, and such as described in JP-A-50-124067, JP-A-63-87435 discloses a network system in which the signal control channels connect each other. JP-A-60-23270 is concerned with an elevator maintenance system.

In all such systems, the problem is the increasing complexity of the interlinking of the various devices of the control system. The present invention is concerned with configurations which seem to overcome, or at least reduce the interconnection of the components of the system.

SUMMARY OF THE INVENTION

The present invention has a number of aspects. As mentioned above, each aspect is concerned with the interconnection of the various components of the elevator control system, and we will first discuss those components.

In general, any elevator system according to the present invention will have a plurality of elevator information generation devices, each of which devices has an information output unit for outputting elevator information. Some of those elevator information generation devices may be in the elevator cabs themselves, but others may be positioned e.g. at the floors at which the elevator cab is to stop. Similarly, in order to provide information to the user, the control system will have at least one (normally more) displays for providing an elevator display.

Furthermore, in general, the system will have an elevator control which receives the elevator information from the information output unit of the elevator information generation devices, and generates elevator control signals.

In a first aspect of the present invention, a display controller is connected to the information output of the information generation devices, and that display controller generates display control signals which control the display(s). The system may have a plurality of display controllers connected to the information output of the elevator information generator devices by a common transmission path, or there may be a single display controller, again connected by a common transmission path. This common transmission path is important as it simplifies the interconnection of the system, and thus second and third aspects of the invention are concerned with the presence of such a common transmission path, interconnecting the display controller and the elevator information generation devices. These second and third aspects, therefore are independent of the elevator controller.

Where an elevator controller is provided, however, that elevator controller may determine the time of transmission of the elevator information to the elevator controller and the display controller and this is the fourth aspect of the present invention.

In more complex systems, it may be necessary to provide separate elevator controllers for each elevator, and in that case a superviser controller may be provided for supervising the elevator controller. In this case, a common transmission path may interconnect the elevator controllers, the superviser controller and the display controller(s).

Other aspects of the invention are concerned with the methods of operating the system, the display system within the elevator system, the method of installation, and the overall elevator system.

The present invention simplifies the control of display devices representing information about the movement of the elevator cab(s). On average, an elevator takes 7 seconds to reach a given floor, 2.5 seconds to open the door, 2 to 12 seconds for passengers to step in and out of the cab, and 3 seconds for the door to close. Since this may occur at an unknown number of floors between one user and the initial position of the cab, waiting for the cab involves an unknown delay. It is affected by the length of time the door stays open, and therefore the number of passengers who enter or leave the cab. If the user is not provided with information concerning the movement of the cab, it is easy for him to become irritated because of the uncertainty in the delay.

Conventional elevator control systems generally do not include data concerning door opening and closing or the running position, i.e. the data for the time required to close the door and start to move to another position. Because of the complexity, conventional elevator systems cannot successfully control several elevator cabs, and faulty operations develop in the programming of the movement which does not assist the user.

In the prior art, there is generally a direct link between the elevator controller and the corresponding display, but this leads to the problem that, where several elevator controls are provided, one display can be linked to another, and furthermore the control for the display, such as display timing etc has to be controlled from within the elevator and this makes the circuitry more difficult. In the present invention, the use of a display controller, preferably connected to the elevator controllers by a common transmission path, simplifies the control of the display. Since the display controller may be varied, it becomes easier to control variations in the displays desired. This is important because the type of information that needs to be displayed is often a matter of fashion, and it is desirable that the elevator display system can be up-dated when desired.

BRIEF DESCRIPTION OF THE DRAWINGS

Embodiments of the invention will now be described in detail, by way of example, with reference to the accompanying drawings, in which:

FIG. 3 shows a cab operation control data table;

FIGS. 4 and 5 show information control data tables;

FIGS. 13 and 14 are flow-charts of information processing in a system according to the present invention;

FIG. 17 shows a transmission control data table;

DETAILED DESCRIPTION

Figure 1A:
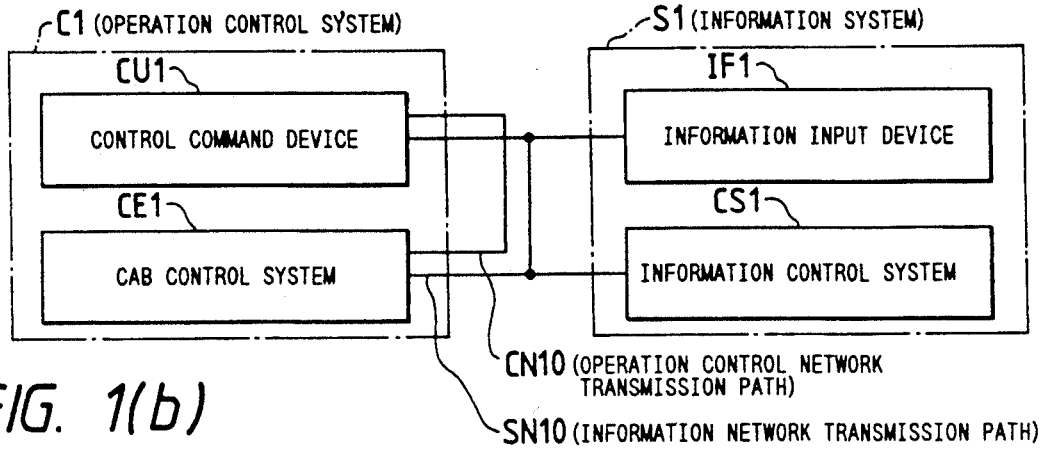
FIG. 1 illustrates parts of elevator control system forming an embodiment of the present invention.
Figure 1B:
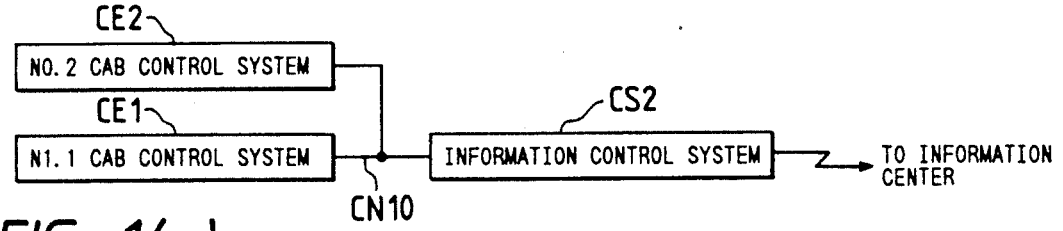
Figure 1C:
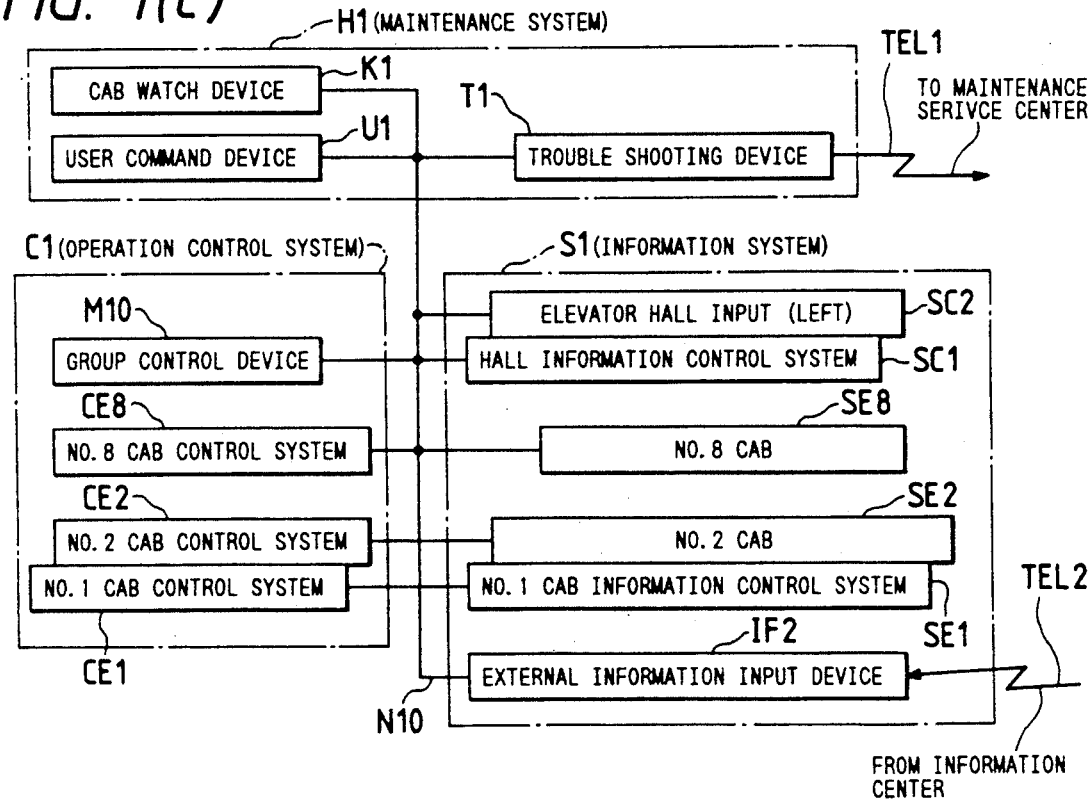

FIG. 1 illustrates a constructional view of an elevator signal control system according to the present invention. FIG. 1(*a*) shows an example of a signal control system applied to the situation where there is a single elevator cab. The system has an operation control channel C1 consisting of an elevator operation controller CE1 and a control commander CU1 that selects the operation control rule or the monitoring of the control state. The operation controller CE1 and control commander CU1 are connected to each other by a connected transmission path CN10 in the signal control channel network. The system also has an information control channel S1 consisting of an information inputter IF1 and an information control channel CS1, which are connected to an information channel network transmission path SN10. The information inputter IF1 inputs and selects the information, designates the information guidance rule, and receives the data from an information center. The information control channel S1 is connected to the operation control channel C1 via the information network transmission path SN10.

The elevator operation control channel C1 transmits data that provides basic control information to the three other devices CU1, IF1, and CS1 through the above network transmission paths. The three devices CU1, IF1 and CS1 receive the data at the same time. This transmission arrangement does not increase the volume of data transmission through the network transmission path CN10 and SN10 but increases the time required for editing the data output from the elevator signal control channel CE1. However, this effect is not a disadvantage in the signal control channel if the information input device IF1 is designed to use only the information network transmission path SN10 in outputting the data to the information control channel CS1.

FIG. 1(*b*) shows an example of an elevator operation control system for two cabs consisting of an information guidance control system that has an individual guidance device at each floor and an information guidance controlling unit to control all of the system channels, where the combined method for transmitting the data for mechanical and effective control of two elevator cabs plus the data for information control channel CS1 is the same as in FIG. 1(*a*). However, since the information control channel CS1 receives data directly from the information center independent use of the network transmission path CN10 can satisfy the purpose of sending the data.

FIG. 1(*c*) shows an example where the present invention is applied to an elevator group control system for eight cabs. In FIG. 1(*c*), the operation control channel C1 has eight sub-channels CE1 to CE8 for the eight cabs and similarly the information control channels S1 has eight sub-channels SE1 to SE8. There is shown the construction of an elevator signal control system including an operation control channel C1, as information control channel S1, and a maintenance channel H1.

When the operation signal control sub-channel CE1 of the first elevator cab outputs operation data to a supervisor controller in the form of a group control device M10 via the network transmission path, the information guidance control sub-channel SE1 assigned to the first cab receives it at the same time.

Likewise, when the group control device M10 outputs service data to the operation signal sub-channel of the eighth cab CE8 to supply information concerning operating conditions at a service floor, a hall-call or other items of service, the information guidance sub-channel SE8 and the maintenance channel H1 that consists of the elevator operation watcher K1, the user commander U1, and the trouble shooter T1 receive the same data at the same time.

The information channel S1 consists of the basic information control sub-channels SE1 to SE8 and the hall guidance control channels SC1 and SC2 that operate the inter-building information devices provided at the entrances of the elevator halls to display guidance information about the floors presently in service and/or event(s) presently held in the building. This channel receives data output from every floor one after another and selects information data generated by an external information input device IF2.

The transmission path N10 takes a complete double channel system to use the operation signal control channel or the information channel individually, because of the high independence of the channels.

Figure 2:
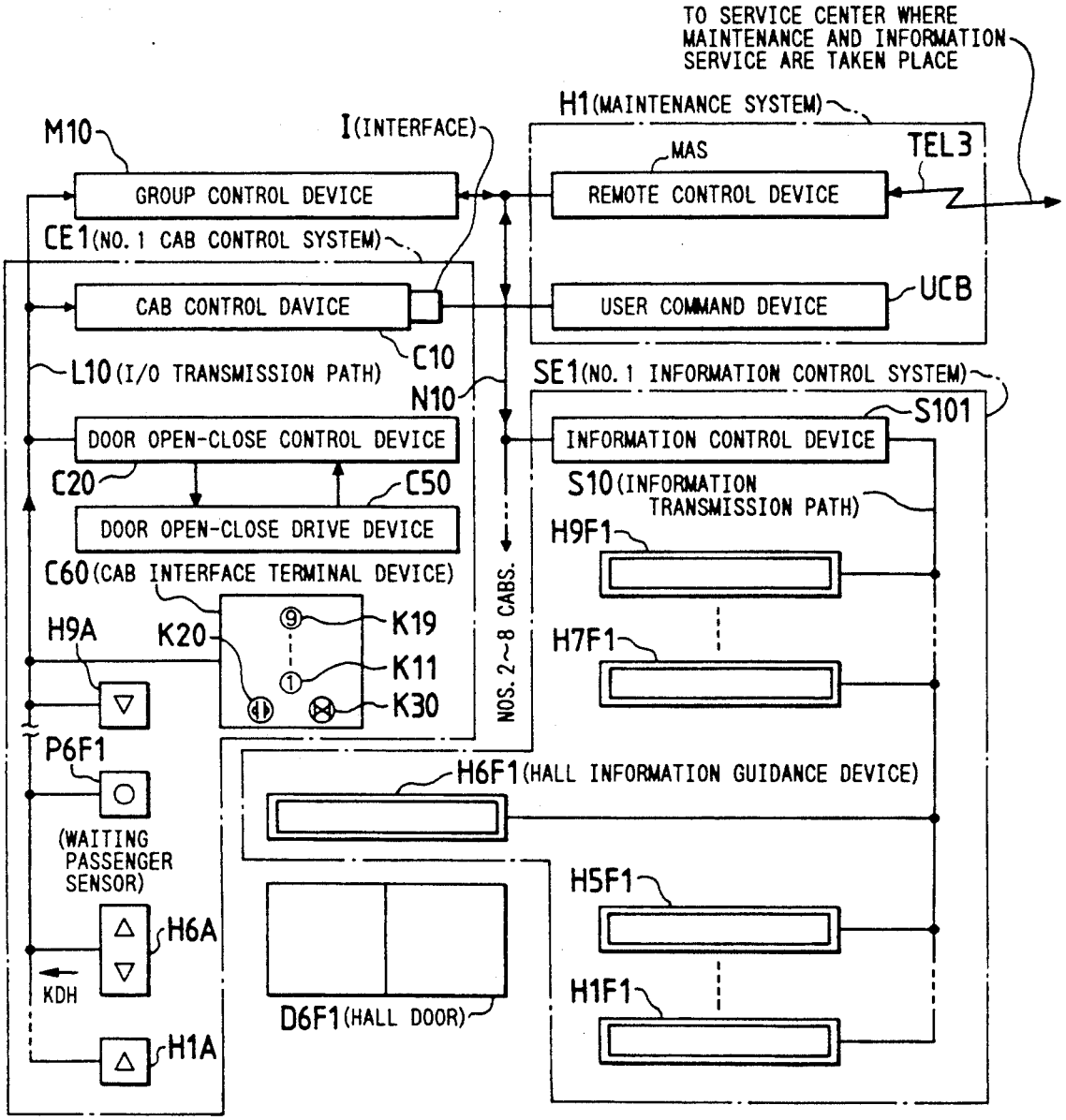
FIG. 2 illustrates the interconnection of parts of the elevator control system.

FIG. 2 shows a general physical constructional view of the systems of FIG. 1(*c*), except that the information control sub-channels SE2 to SE8 respectively assigned to the second to eighth elevator cabs and the elevator operation signal control sub-channels CE2–CE8 again assigned to the second to eighth elevator cabs are omitted for the sake of clarity.

The operation control channel C1 consists of group control device M10 and the elevator operation control sub-channel assigned to each of the eight cabs (only sub-channel CE1 being illustrated).

The elevator operation control sub-channel CE1 assigned to the first cab consists of an elevator control system C10 connected to the transmission path by a suitable interface I, a cab door open-close device C20, a door open-close driver device C50, a cab interface terminal device C60, and a floor interface terminal device H6A.

The information control channel SE1 of the first elevator cab which forms a part of the information channel S1 consists of an information control device S101 and a transmission path S10, which intake the data from the network transmission path N10 to form that data into a signal and outputs that signal to drive the hall information guidance devices H1F1 to H9F1. These display information based on the data in LED display boards or in speaker devices.

Building managers can make use of the user command board UCB in the maintenance system H1 to input or alter the information guidance program, elevator operation mode, timing, and the extent of cab service with its appearance in the information guidance devices (Major signals for the assignment are illustrated in the user command tables in FIG. 5). Such managers can monitor the state of the elevator cabs in service and the performance of each cab in passenger service.

The data in a general purpose information table USTBL (see FIG. 5) is output from the user command board UCB, to show e.g. a weather forecast (data predicted by US1 in FIG. 5) or traffic guidance information such as a train time table or the time a taxi would take to reach stations (data indicated by US3 in FIG. 5) for the convenience of the passengers of the elevator. That output data is passed to the information network transmission path N10 and reaches each of the control devices (S101, C10, M10) simultaneously.

The maintenance channel H1 also has a remote control maintenance system MAS, which is a double function device including the information input device IF2 and the trouble shooter device T1 mentioned above in FIG. 1(*c*). This may be connected to the service center by a telephone line TEL3 for service, maintenance, and general information.

A sensor P6F1 generates information indicating how many passengers are waiting at a cab doorway located at the 6th floor. Similar sensors (not illustrated) are provided on the other floors. The sensor P6F1 supplies a data signal indicating how many passengers are waiting at the hallway to every device of M10, C10, and C20 via the I/O transmission path L10. This signal may be connected via the information transmission path S10 when required by the first elevator cab information control channel SE1 in some cases.

In a similar way FIG. 2 illustrates other elevator information generation devices on the sixth floor (again similar devices being provided on other floors).

It can be seen that the group control device M10, the user command device UCB, the network transmission path N10 and the remote control maintenance device MAS are used in common but other functions individually would require a system with as many devices as elevator cabs. FIG. 2 also shows hall door D6F1, being the door at the elevator doorway on the 6th floor.

The group control device M10 receives the button's hall-call signal from an interface terminal device H6A located at the cab doorway of every floor, selects and designates the service elevator by the method discussed later with reference to FIG. 8 and that mentioned in the official gazette Toku Kai Sho 59-223672, and transmits service instruction for responding to the hall call signal KDH to the designated cab control device C10.

FIG. 3 illustrates the tables contained in each device (C10, M10, UCB, MAS and S101) for storing the data acquired through the network transmission path N10 between the group control device M10 and the elevator operation signal device C10. The data table CMTBL of the cab stores data output from the network transmission device C160 of the elevator control device C10 shown in FIG. 7 (to be discussed later). The signal is received not only by the group control device M10 but also simultaneously by the remote control device MAS, the user command device UCB and the information control device S101.

All of the signal intake devices prepare table CMTBL corresponding to the number of the intake devices. The CACD-CWG has memory of 1 byte in general, but the cab calling CC has to have 8 bytes at the 64th story. The byte for door opening requires only 1 bit each for signals COPEN-CCLLCS.

Likewise, the group control data table MTBL taking charge of overall common information output from the group control device M10 and the individual control instruction data table MCTBL taking charge of individual elevator cab simultaneously not only to the elevator operation signal control device C10 that covers the first to eighth cabs but also to the information guidance control device S101.

This way of constructing the network transmission gives the advantages of (1) diminution of process on the output force at each device, (2) combination of informational channel and operational signal channel by means of the network transmission path, and (3) independent designing, enhancement of performance and remodelling of the informational channel. The transmission format shown in FIG. 16 takes charge of control on the transmission data output from the control table shown in FIG. 17 in determining if the data is necessary or not for transmission and designating the address of the receiving table. The network transmission path makes an orderly transmission according to the bus use permit signal like the time chart shown in FIG. 18. FIG. 19 represents an example of a process flow in the network transmission path.

FIG. 4 represents the cab operation data table CSTBL output from the first elevator operation control device C10 and the service condition data table MSTBL output from the group control device M10. These signals are necessary for an information control device S101 to generate reports of the service condition of elevator cabs, which are transmitted to the hall information devices H1F1 to H9F1. In addition, an incoming passenger detection signal CINMP indicates a passenger moving to and stepping into cabs during the time the door is open, sensed by the device P6F1 (which detects the movement of waiting passengers) each of which is located at the cab doorway. Alternatively a suitable signal may be generated by a photoelectric device which senses passengers stepping in and out of the cab. This is necessary for representing the pattern D12A or D10A shown in the display illustrated in FIG. 10.

FIG. 5 represents the use command table UCTBL mentioned previously. This is the signal output by the user command device UCB to the information channel C1 and the general information data table USTBL that is the signal output to the individual information control sub-channels CE1 to CE8 of the cabs. The data of the UCTBL is considered to be an important control rule. It should therefore be recorded in an EEPROM to prevent data loss due to loss of power or UCB power failure.

Figures 6A, 6B:
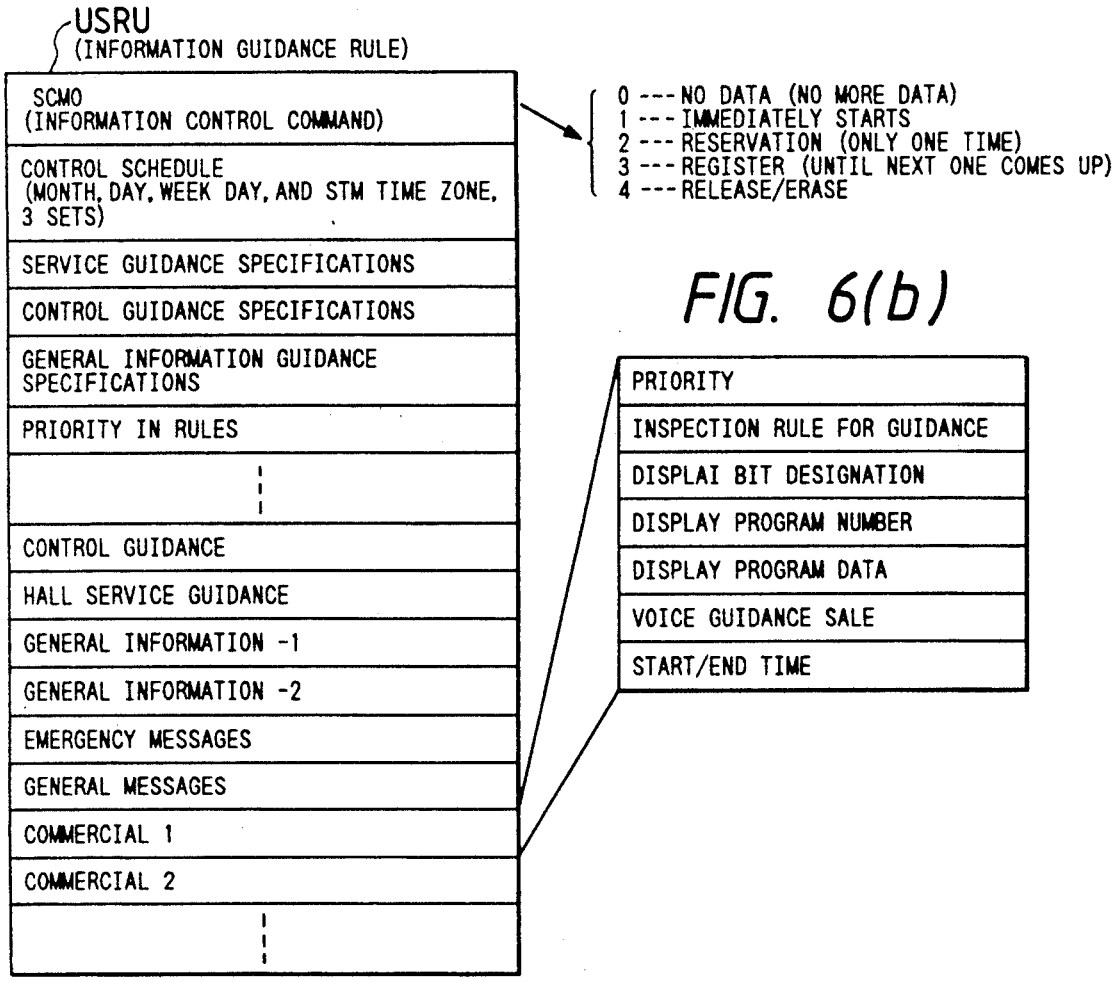
FIG. 6 shows an information guidance rule table.

FIG. 6(*a*) represents a transmission table for recording the information guidance rule USRU in the general information data table USTBL, as stated in FIG. 5.

The information guidance control device S101 of each cab receives the operation rule data in the control schedule to commercial 2 and stores it in a semi-permanent memory device EEPROM or an IC memory card. It thereafter reuses the data, receiving it from the control channel CE1, to generate guidance information following the rule determined by the group tables, as shown in FIGS. 3 and 4. The information guidance control system analyses these tables to see if any of them belong to the rules of the control command SCMD or the service guidance or hall service guidance or elevator cab condition guidance. It also checks to see if any information guidance device displays the data thus selected.

FIG. 6(*b*) shows an example of the CSM1 table specified in a commercial control system, whose construction is available for all specifications mentioned regarding cab service guidance and further instances.

Figure 7:
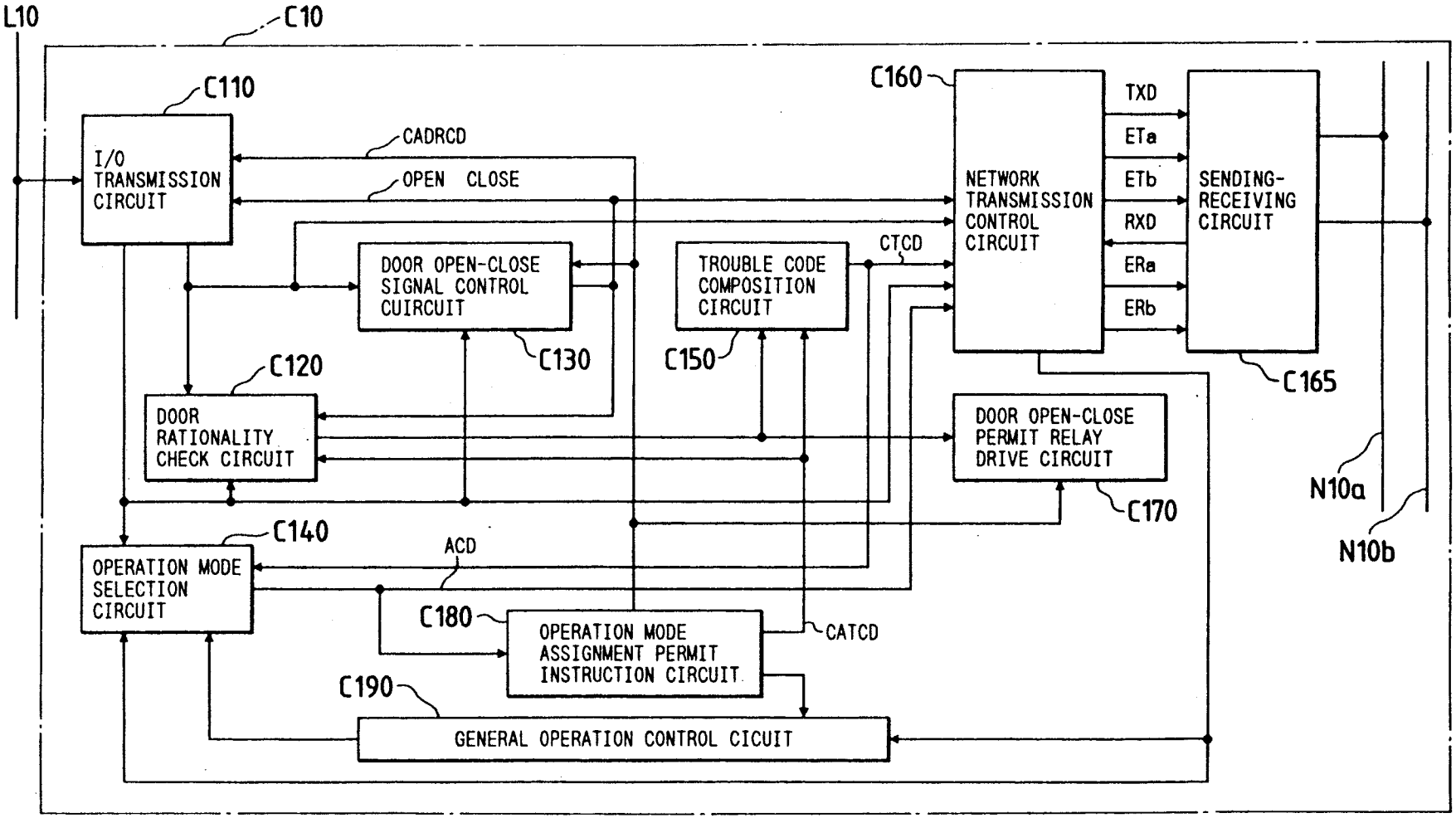
FIG. 7 shows a cab control circuit.

FIG. 7 is a block diagram representing an example of an elevator operation control device C10.

In FIG. 7, the I/O transmission circuit C110 receives a door open terminal position signal COPLS or cab call button signals K11 to K19, cab door open-close button signals K20, K30 and the safety shoe signal CSHW from I/O transmission path L10. FIG. 7 illustrates the output of the OPEN and CLOSE signals that instruct the door to open or close, the signal to cause the response lamp to light the signal to cause the response lamp light permits a cab call to be answered, the signal for indicating a half-open door and the permit signal for door closing is derived from activation of an open button K20 or a close button K30.

The network transmission control circuit C160 outputs a signal CSTBL which is the data table for operating the individual cab data table CMTBL in the form of serial transmission data TXD and transmits it through the send-and-receive circuit C165 to two transmission paths N10*a* and N10*b*.

Output permission signals are indicated at ETa and ETb. A data "1" signal can be substituted for ETa and ETb. Shown at ERa and ERb are signal intake path selection signals (only one of which can be at logic level "1"). The control condition data table MTBL, the control instruction data table MTBL, the control instruction table MCTBL and/or the user command table UCTBL is received through either one of the network transmission paths N10*a* or N10*b*.

The send-and-receive circuit C165 controls data transmission in the network transmission path N10, where the data sending and receiving is between the group control device M10 and the information control device S10. This is controlled by the circuit C165. The data play interruption into the information control device S101.

The information control device S101 transmits the data (illustrated in FIG. 15) to individual hall information guidance devices H1F1 to H9F1 independently, following the data transmission path, and controlled by the send-and receive circuit S165. The operation mode selection circuit C140 determining the operation mode number CACD from the signals of the trouble shoot code CTCD, the operation control mode number MACD, the operation control board i.e. the cab interface terminal device C60's operation selection switch. (Refer for detail to the article in Official Gazette Toku Kai Sho 58-119567).

This signal generates a permit signal that determines the specification suit to each control circuit in the general operation control circuit C190 through the operation mode permit instruction circuit C180 and also determines at the same time the door open-close mode instruction CADRCD and the trouble shooting mode instruction CATCD repsectively, which are transmitted to the door open-close signal control circuit C130 and the door open-close permit relay drive circuit C170 as well as the door rationality circuit C120 and the trouble-shooting code making circuit C150.

The door open-close signal permits the relay circuit C170 to include the door rationality check circuit C120 that troubleshoots if a problem occurs at the door open-close control device C20 or the door open-close drive device C50, and turns off the door open-close permit relay (not illustrated) to make it inactive. This prevents the door unexpectedly opening during the cab's normal operation. The signal given for the normal operation is "close torque" under which vibration does not cause the door to open. A faulty semiconductor may let the door open occassionally, however.

The permit relay can cut off the drive voltage at the door open-close drive device C50 when it senses even a small change in the door close position to put on the disc brake in the door open-close drive device C50, to prevent no further door open-close action. The permit relay has a "fail safe" system where the action of other contact points simultaneously can stop the cab from running.

Figure 8:
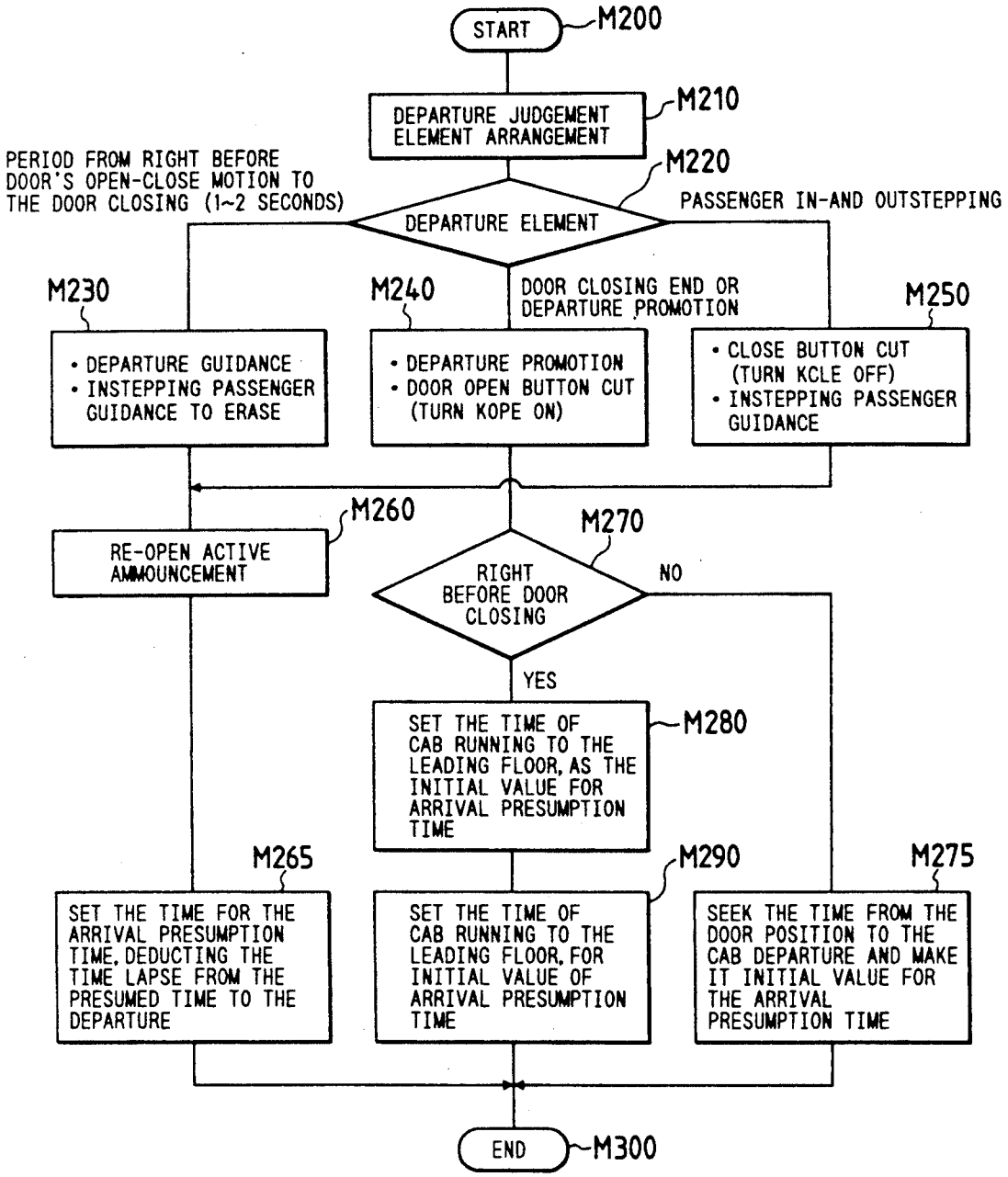
FIG. 8 is a flow-chart of elevator operation according to the present invention.

FIG. 8 represents a flow chart of the operation of the control device in improving the guidance of programmed elevator cab services, taking advantage of continuous door open-close position signals.

Figure 10:
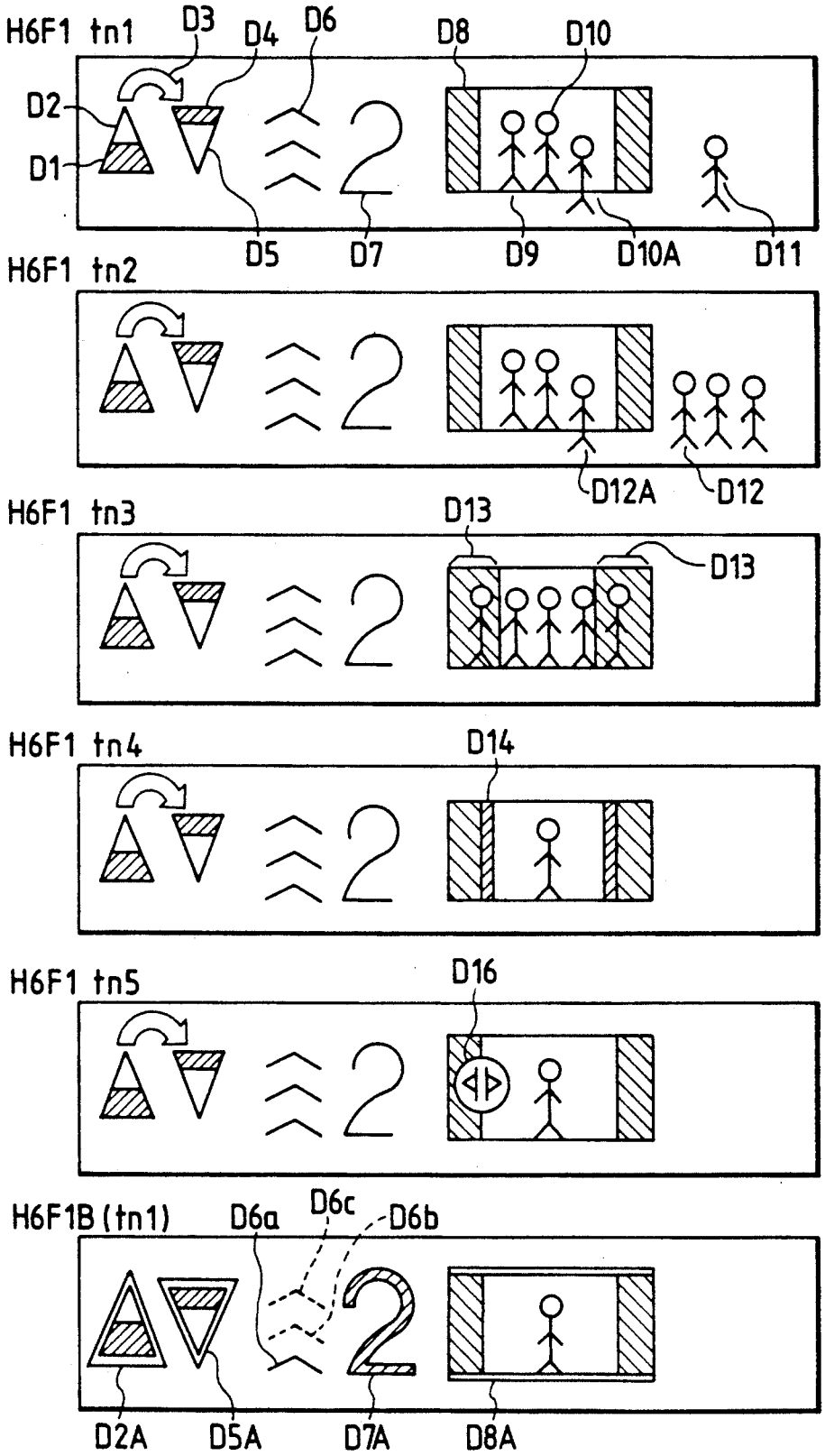

The process flow starts by determining the initial values for the guidance information in the display devices located at the elevator service floors and in the cab, the arrival program data table to be combined in the group control device M10, but now also it combines with the information guidance control system S101 that covers the waiting time guidance devices (D1 and D4) as shown in FIG. 10, giving improved functioning.

The reason why the signal for the programmed waiting time is not transmitted from the group control device M10 to the information control device S101 via the network transmission path N10 is that the number of data tables would become so large (the amount of data is calculated by the number of elevator cabs (3 to 8)×number of floors (2 to 40)×number of operation direction (2) to result in (12 wards—640 wards)) that it would be difficult for the operational channel C1 to accept it. The increase also may induce problems of short times for data processing in the control channel C1 and would cost more to convert into a high speed system. The problem of degradation of the anti-noise properties in the system would also have to be addressed.

FIG. 8 represents the process flow originally used for cutting the "closing button" to promote quick action of the elevator at a service floor, taking a speed cycle of 0.1 to 1 seconds per step for cab motion, where the cab starts at Step M200 and collects the elements to determine the condition of motion at Step M210 and selection of the condition for beginning cab motion at step M220. The process flow first determines if a passenger is stepping in or out of the cab and branches out to Step M250 to make "close button cut" and displays the guidance to intake a passenger stepping in the cab when the cab has arrived at a floor.

Next, the process flow advances to step M260 to declare "reopen available", then to Step M265 to set the initial value which is the time at which the time "STOP" signal passed from door opening is substracted from a presumed arrival time length to cab departure YSTOP.

Next, when the process flow determines that it is at the point at the beginning of door closing (1–2 seconds) and the time the door is in closing motion, the process flow advances to Step M230 to output the signal that instructs to stop the departure signal and stop the guidance display indicating passengers entering the cab.

When the time passes over a programmed stopping time HSTOP, or the congestion inside the cab reaches a predetermined rate HLOD, or the cab door edge is judged too close to a predetermined value (100–300 mm) to cause a large loss of time to make the door reverse action, or if departure has already been indicated, the process flow advances to Step M240 to output the signal to the control channel to ensure the departure and cuts off the action of the door opening button.

At the same time, the information channel acts on the "hall information device" H1F1 to H9F1 to display a visual sign "Please wait for next cab" or "Please take other line" when a cab will soon arrive or a neighbouring cab will soon arrive and to cause the "cabs-interior information device" to display "Ready to depart", "Door will not open" or "Cab delayed, Door will not open" when the door is beginning to close, using audio signs such as a human voice or a chime or a buzzer for guidance.

When it is determined that Step M270 right before door closing is completed, the processing moves to Step M280 to cause the leading cab proceed to the next floor programmed, and uses Step M290 for calculating the time to run to the next stop and inputs the data for the initial value of presumed arrival time.

In this type of elevator operation, some cabs may pass more than one floor, but a waiting passenger will not get angry because he has no knowledge of how the elevator system is working. Any such passenger is advised that he will have a vacant cab in the time displayed on the guidance device.

It is most important for efficient elevator service that a cab first goes to the floor where many passengers are waiting than going to a floor unexpectedly requested by people whose number is unknown. This cab system however, keeps vacant cabs run down to the 1st floor regardless of the number of waiting people, if a cab call has not been made by some one else from other floors.

Figures 9, 12:
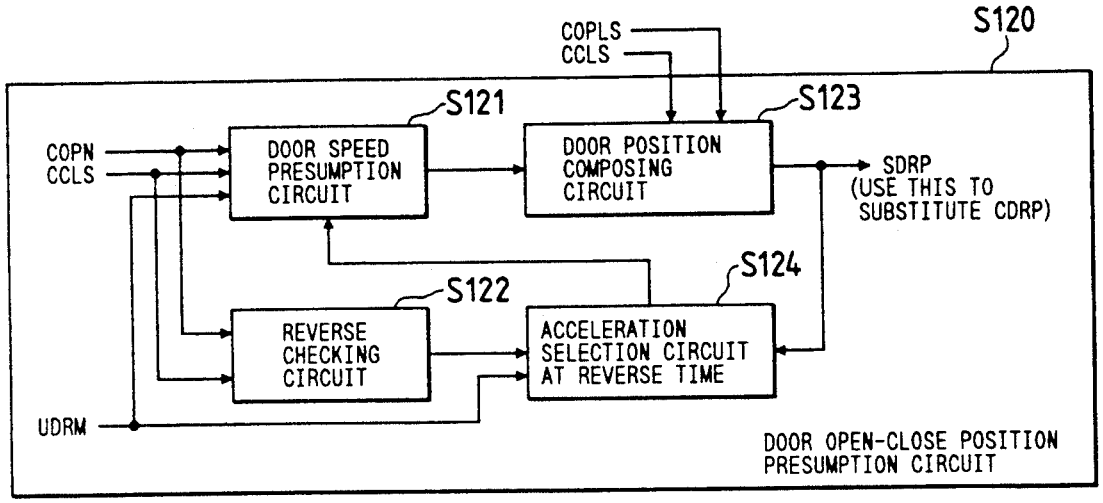
FIG. 9 is a diagram of a circuit for door position.
FIGS. 10 to 12 show elevator displays.

FIG. 10 shows an example for guidance information displayed in hall guidance device H6F1 fixed to the top part of hall door D6F1 at the time the first cab is at the 6th floor of the building. FIG. 12 depicts the same example accompanied by voice guidance.

FIG. 9 represents the door open-close position presuming circuit S120 that acts as an information device for the door open and stay position SDRP to substitute the door open-stay position device CDRP in the information control device S101 in an emergency where the network transmission path N10 cannot send the door open-close signal (CDRP, CCLTM) to the information control channel of the first cab.

The circuit S120 consists of a door speed presuming circuit S121 that produces door speed data using the open-close instructions COPN and CCLS that form a part of the cab's data table CMTBL, a reverse action detection circuit S122 that senses the door's turning point to reverse its direction by checking the open-close signals, an acceleration selection circuit S124 that makes a presumption of the door's acceleration speed in reverse action based on the data taken from SDRP which is the signal of the continuous door open-close position UDRM, and a door position circuit S123 that integrates the door speed to produce the position and functions to compensate for the door open-close signal by the door open limit switch signal COPLS and the door close limit switch signal CCLS. This determines the door open-close position signal SDRP and outputs it as information data.

The reason this invention may make use of the above-mentioned circuit S120 is as follows: the elevator door speed consists of an arrangement in which the upper limit changes depending on the condition of the door if open or closed, the position it is at, and condition of forward or reverse motion. Circuit S101 allows setting of the door mode UDRM, including the door speed, the acceleration, and the reverse control time, by using the user command device UCB individually for each group control channel of the operation control mode number MACD and traffic demand mode MTRFCD. The door speed presuming circuit S121 makes a presumption of the door speed taking all these conditions in consideration. The signal thus determined is used for selecting the picture element display by determining device D8.

FIG. 10 represents an example of picture elements displayed by the display appearing in the information device H6F1 located at the cab doorway at the 6th floor. The steps tn1 to tn5 illustrates changes in the display of the information device H6F1.

The step tn1 shows the situation where the cab door stays open at the second floor at which a passenger is stepping out the floor being indicated by Pattern D7. The display also indicates by that the cab door is open and pattern D11 shows that a passenger is stepping out of the cab.

Patterns D1 to D4 show triangles illustrating the first cab moving to the 6th floor, those triangles indicating the direction of movement and representations of time to reach the proposed floor. The patterns show the case where the cab moves downward after first moving up. Arrow D43 indicates the order of those operations. Pattern D6 illustrates the present direction of movement the first cab. Patterns D9 and D10 represent the number of passengers.

The animated pictures D10 and D11 illustrate schematically passengers stepping in and out of the cab to indicate that 3 people stepped out at the second floor. This gives a visual understanding of the cab situation that causes a feeling of unconscious relaxation to passengers waiting at the sixth floor of the building. It is a service which will be welcome to busy people in the modern age.

In display of the Pattern D8, the cab frame may be colored in green, the congestion rate in the cab, the passengers in orange or red, the Patterns D4 and D5 green, and the closeness of the elevator (depending on the number of stopping, the difference in floors and the reservation for a downward move) is represented in Pattern D1 and the increase of D4 in the display.

The Pattern D3 and the cab positions illustrated by D6 and D7 may be coloured in yellow. The direction of elevator motion direction is represented by movement of Pattern D6; controlled e.g. by an animation device (FIG. 11-6 D61–D65 or D6 ($t_1$)–D6($t_3$)) or by arranging block line of light (H6F1B) to move up the display (D6*a*–D6*c*) to imitate the movement of the cab. Even if Pattern D3 does not have a device for illuminating the lights in order, people would clearly understand the cab motion when three elements were distributed as a set.

The step $tn_2$ illustrates an animated picture with Patterns D12 and D12A showing three people stepping into an elevator cab at the second floor. There are two ways of checking congestion at other floors; the simple way is to judge it by cab calls, or hall calls and checking the change in the cab load sensor value or the data acquired at the waiting passenger sensor.

Step tn3 represent an animated picture in which D13 shows the door closing. At this time, if the overlapping part of the picture D9 that shows congestion inside the cab, and part D13 (that shows that the door is closing), is colored in yellow or no color (no light) black, a better result display can be expected with better guidance effects and appearance on the LED board, consisting of a two color (red and green) light source.

Another type of elevator system may have a different specification so that the door will reopen when a cab call is made at the second floor for upward motion. (The mode can change over if hall call service mode UHSVN is set by the user command device UCB). However, no elevator is prevented from departing in general.

When the mechanical shoe provided at the tip of a door activates, Pattern D14 of step tn4 represents the reason for door reopening and can make a display at the sixth floor to indicate this to waiting passengers. Furthermore if an elevator is obstructed from departure by the open button K20 of the operation board (provided in the cab interface terminal device) C60 this can be shown e.g. by Pattern D16 of step tn5. If the open button is kept pressed by accident, people waiting at another floor may wonder if the telephone service is out of order or that waiting is hopeless when the elevator system is of conventional type showing only the cab position but no other guidance. However, this system can represent not only the reason for the delay in departure, but also the state in the guidance device at all other floors by means of Pattern D14 and D16. This may ease irritation of waiting passengers. Since unnecessary button pressing also appears in the guidance device, people will be less likely to play unnecessarily with the buttons.

This arrangement represents the close button promoting operation together with D16, checks the state of passengers continuously stepping in by a photoelectric device (CPH) and represent it at D10A or D10A. When the opening elongation button is to be used for 15 seconds to 3 minutes, the system replaces the color of Pattern D16 open button from green to red and reduces the red part and increases the green in accordance with the ending time (CCLTM) for representation. If set at any floor (at the second floor in this instance) and the cab stays at another floor a long time, the passenger at e.g. on sixth floor will then be told if the cab gets out of order.

Stage tnI shows another example of a timing display referred to as H6F1B. The direction of elevator operation is shown on animation moving from representation D6*a* to D6*c*. Cab frame D8A is made a little bigger and colored in green.

Figure 11A:
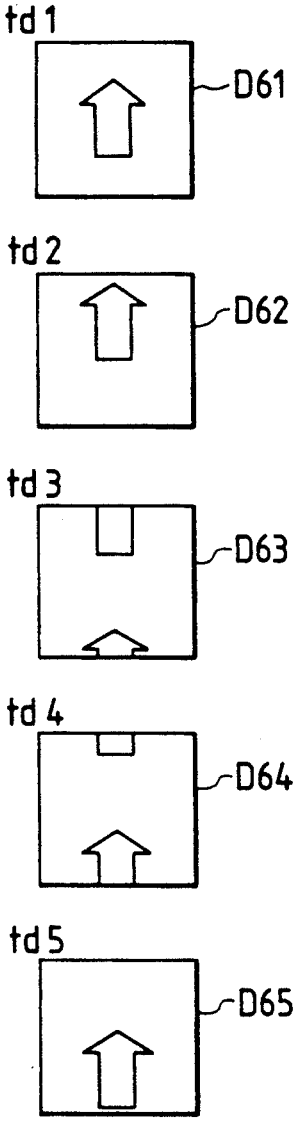
Figure 11B:
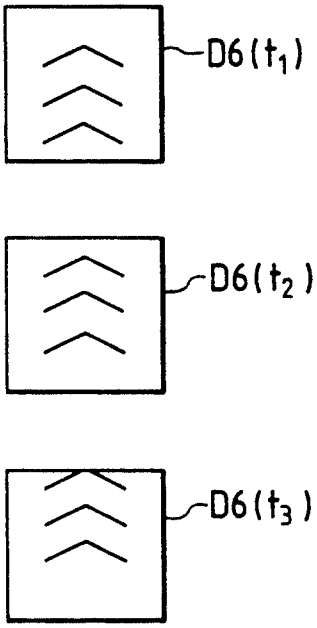

FIG. 11 is another example of animation guidance by this invention applied to the elevator operation direction.

The steps td1 to td5 represent elevator operation showing upward movement by advancing the scrolling of the pictures in the direction of the arrow. This animation method can be substituted for Pattern D6 in FIG. D10 such scrolling has the advantage that the watcher can see the operation direction instantly. FIG. 11 then represents another example of this method applied to this invention.

FIG. 12 represents letter guidance from information guidance device H6F1 at the sixth floor which may be provided additionally to the display device shown in FIG. 10. The picture to be represented is same as that of steps tn1 to tn5. They are well balanced with the previous patterns. In the zone, the picture guidance stated in FIG. 10 and the letter guidance stated in FIG. 12 are used in turn in the mode of flow or turning over pages. It is recommended that the display occurs a little earlier when on LED, displaying pictures of FIG. 11 and voice guidance occurring at the same time.

It is advisable that, for the purpose of wide publication of this system this arrangement, information about the system be broadcast at the site of a newly erecting building (or at the busiest period of time people crowd in an already opened building) to explain the animation guidance and the voice guidance (discussed in FIG. 12) in turn.

The user command device UCB can control the level (how courteous or educational) of the voice guidance and requirements (only at congestion times or all day), and the broadcast is made in line of hall service state guidance information specification USRU which is a part of the information guidance rule.

FIG. 13 represents the flow chart of information guidance, based on FIGS. 10 and 12 with controls performed by the information control device S101. To process one by one the output of guidance control instruction signals to the information guidance device H1F1 via information transmission path S10, the START (S500) operation is automatically activated to repeat on 0.1 second cycles. All floor guidance can be achieved by setting the initial set (S510) and completing the loop (S740) Step S520 is first and to judge if the KDH table is assigned to an upward hall call made from floor "i" (in case of elevator cabs provided side by side) or the hall call table HC (for one single cab) and to calculate the presumed time for cab arrival at floor "i". This calculation makes use of waiting time calculation parameter MWTP and also seeks the probability of stopping of the cab between its present position and the "i" floor. By this operation, an appearance instruction can be issued for Patterns D1 and D2 after selecting a picture element previously recorded in the information guidance device H1F1. Likewise, the existance or non-existance of a hall call for downward motion can be determined by S540 and downward waiting time guidance is issued, the displayed Pattern 3 and D4 by Step S550.

Step S560 determines if the cab is in elevator service in two directions and instructs the appearance of the U turn light illustrated by Pattern D3 at Step S570. The cab position CPS1 or leader cab position CFP1 is determined at Step 580 and an instruction is generated to display an "out of order" display at Step S730 if the cab position is not within the prescheduled area.

Consider now an example representing the position of the leading elevator cab CFP1 in the cab position guidance Pattern D7 that shows the leading cab position moving in the advance direction from the right before departure by means of the information guidance rule USRU that partially forms the general information table USTBAL.

Cab position guidance D7 appears as a pattern or figure of the floor, e.g. the 5th floor, at the time when there is no call for stopping from any floor including the 2nd to 5th for example, immediately before the elevator door closes to prepare for departure as arranged in Step 590. This has the advantage that all people waiting at all the floors can visually and promptly understand the elevator cab operation. People just arriving at the cab doorway will know that the first cab would pass e.g. the 3rd floor which they are on. Step S600 issues the instruction to Pattern D6 to have Step S610 judge UP from the operation direction signal CD1R that is a part of the data table CMTBL. At this time the UP scroll responds to the flow of the elevator CSPD at a suitable speed.

Likewise, Step S620 judges the downward direction and Step S630 instructs to display Pattern D6 "Downward guidance". At the time of door close-standby with no operation direction, a pattern showing the elevator cab in a standby state appears at the location of Pattern D6 by following Step S635 and this is erased after a predetermined time following the "erase" instruction at the end of the predetermined time following the prearrangement of the information guidance rule. At Step S640 it is determined if the door has remained open, and Step S730 displays the "out of order sign" if there is an irregularity. If there is no trouble, the signal advances to Step 650 and instructs Pattern D8 to D13 to display the interior congestion of the cab. At Step 660, the period of time from a few second before the cab speed diminishes and the door opens to the end of door closing is determined by means of the door-open position device CDRP and the door open instruction COPN. If the cab is within the period of passenger's stepping out according to the number of passengers inside the cab device CWG, and if there is any passenger requiring to step out at a floor by the cab call CC table, processing preceeds to Step 670.

At Step S670 an instruction is issued to display the animation picture in Patterns D10 to D11 to indicate passengers stepping out of the cab, and responding to the rate of the number of passengers OUTP supposed to get off the cab at the "i" floor. At the same time an instruction is issued at Step S670 to output the inside-cab crowd appearing in Pattern D9, responding to the value of inside-cab passenger number.

Sometimes the cab has no cab call passenger CC to step out. In this case the instruction appears "IN (step-in prepared)" if the "i" floor is the 2nd floor. If "i" floor is other than the 2nd floor, "cab crowded" shows up.

At Step S680 the door close completion foretell time CCTLM is determined and the existence of a door reopen signal, and step-in including period, and the processing moves to the next Step S690. The extension of door close completion time CCLTM based on the door re-open signal is applied in other examples of the application separately.

At Step 690 the step-in passenger guidance is displayed in Pattern D12 in order to provide passenger guidance. Where cab 1 determines that there are no passengers waiting at the 2nd floor interruption of cab congestion appearance is made.

When a judgement of door reopening is made at Step S700 on the step-in detection CINMP signal by means of the open button COPN, safety shoe SCHW, photoelectric device, or image processing device, Pattern D14 and D16 display guidance of the door reopening and delay in departure are indicated at step S710.

Figure 14:
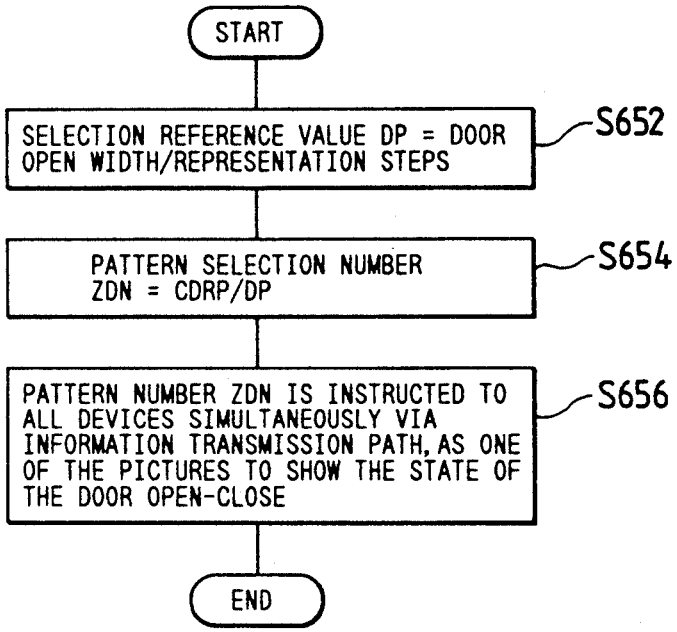

FIG. 14 is the flow chart that shows the details of Step S650.

The first Step S652 corresponds to the calculation of the selection standard value DP. In the next Step S654 the pattern selection number is calculated. The pattern selection number ZDN can be acquired when the door stay open position CDRP is divided by the selection standard value DP. The practical selection of the pattern that responds to the open position is made by this method.

At Step S656 a simultaneous instruction is issued to display the pattern number ZDN acquired form Step 654 on all devices via information transmission path S10.

Figure 15:
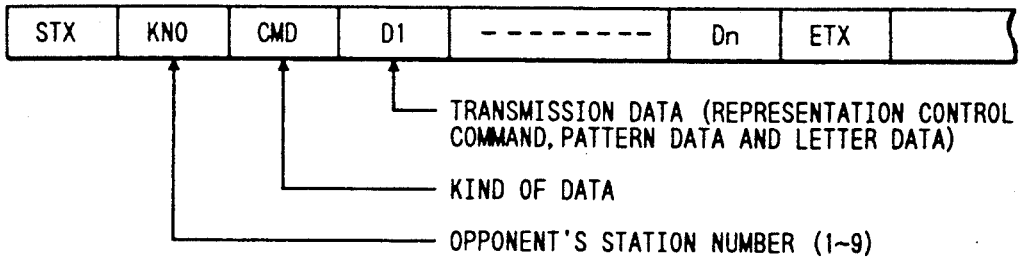
FIG. 15 shows the format of data.
Figure 16A:
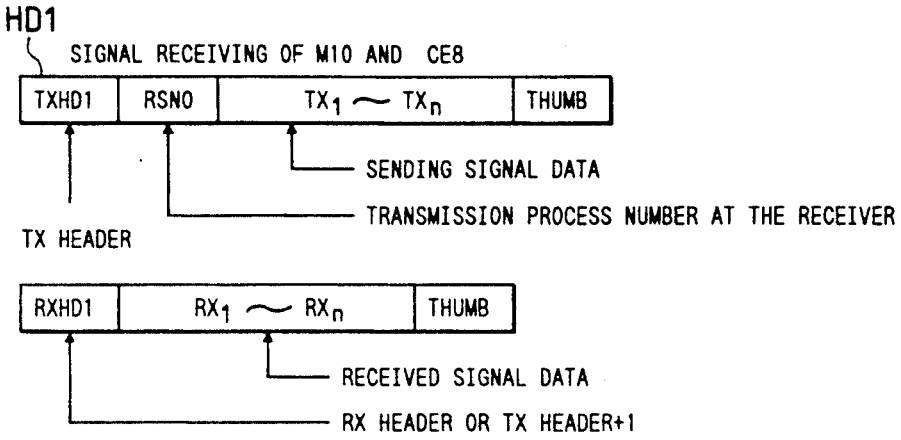
FIG. 16 shows other data formats.
Figure 16B:
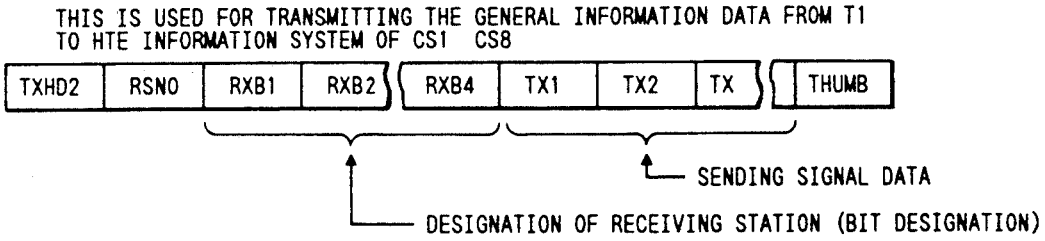
Figure 16C:
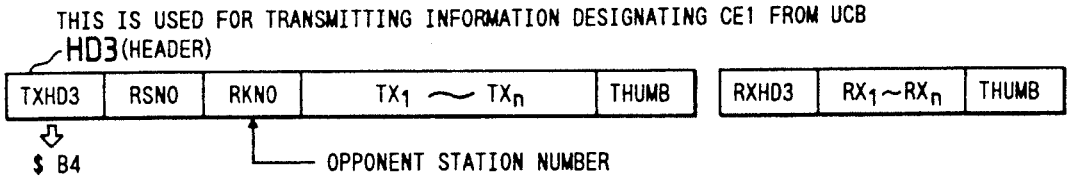
Figure 16D:
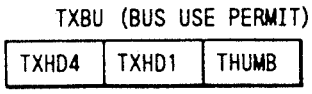

FIG. 15 represents the construction of data to flow from the information control device S101 to the hall information guidance devices H1F1 to H9F1 via information transmission path S10. The addressee's station number KNO have values of 1 to 9 each corresponding to H1F1 to H9F1. If the value is set to the addressee station KNO, it turns out to be the simultaneous instruction addressed to all devices. This promotes high speed processing (of S580 to S635) in the information control device S101 and economizes the data transmission time in the transmission path S10, in responding the instruction of cab position representation (Pattern D7) and the cab congestion presentation (Pattern D9). The data classifier CMD classifies the signal to display it and sends the picture or code to D1 to Dn. If the construction of data stated in FIG. 15 is changed, the contents of the representation picture also changes.

The above explanation shows how to process the elevator service guidance that is a part of information device in FIGS. 13 to 15. The guidance signal sent to the information guidance device of the first cab staying at the sixth floor in FIG. 2 have also been discussed. The signal at other floors is also processed by the repetition of initial setting (S510) and Step S740 (action completion judgement). If the process includes all the actions of the other cabs, the volume of signals will demand more time and higher speed in actions of the information transmission path S10, resulting in a high cost which is unnecessary for single cab elevator system.

The above discussion assumes one device each for the informational channel of each cab, in a similar way to the operational control channels (C10–C60), taking advantage of the one network transmission path N10 of this invention combines with a function to accept the operational signals at the same time.

Figure 20:
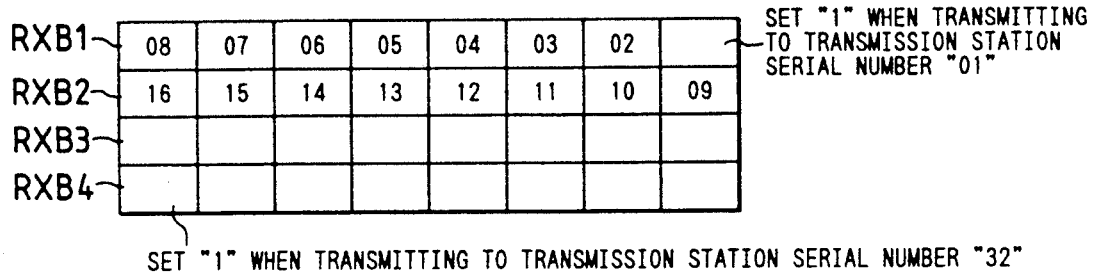
FIG. 20 shows a part of the data header of the format of FIG. 16.

FIG. 16 represents the transmission format and FIG. 17 shows the signal control table TRXMT of the transmission process number RSNO at the receiving terminal. FIG. 16(*a*) represents the transmission format consisting of an addressee terminal No. TXHD1 positioned at the head, a receiving terminal transmission process number RSNO in second place, data TX1-TXn composed of data of n bytes and the check data thumb value (from TX header to data TXn at the last byte) at the end. The reply format consists of a reply header RXHD1 that is same as the sending header THXD1, the reply data RX1 to RXn and the thumb value. FIG. 16(*b*) represents the transmission format to be used for common data transmission bound to a plurality of terminals. The method of setting the terminals can be at the rate of 1 bit per terminal in the receiver terminal designation block RKB1 to RKBn (as shown in FIG. 20). The receiver terminal determines whether to receive the signal by a mode bit turned on or off inside the receiver terminal setting block RKB1 to RFBn as previously defined in selecting the signal. As a rule a reply is not required, but the mode can be restricted to receive only a signal from the station designated by the sender header TXHD2.

FIG. 16(*c*) represents the transmission format where the addressee NO. (RKNO) of each transmission is designated by the operation controller device (host microcomputer).

FIG. 16(*d*) represents the transmission format of bus use permits in order to transfer the right of using the bus by sending the format as a permission for bus use. The permit format contains the bus use permit header TXHD4 and the bus use permit station header TXHD1. This relates to the control table TRXMT that governs the transmission process number RSNO at the transmission terminals.

All of the network process terminals have a RSNO control table TRXMT inside the terminal RAM for making transmissions (sending and receiving). This is true where the control table TRXMT of the station designated by the bus use permit signal (whose format is indicated in FIG. 16(*d*) that has come from the network transmission control circuit which is the representative terminal in control of the network transmission path N10 and the station assigned by the receiving station designation block RXB shown in FIG. 20 carries out the transmission, following the block specification designated by the transmission RSNO and assigned by the host.

Specification of blocks assigned by the transmission number RSNO includes registering protocol concerns such as the header number for assignment of the addressee station, the transmission paths SN10 and CN10, the determination of the existence or non-existence of the BCC check caused by the data thumb or horizontal parity code, data receiving by interruption, the existance or non-existance of a sending permit, the sending data number, the sending table address, and the developing rule for receiving data. It is necessary for all of the terminals to have specifications as required. The individual registering from the representative station through the initial transmission, providing the data are same for all terminals, and the features are (1) the representative terminal can control all of the transmission path, and (2) the representative path can be easily replaced.

Figure 18:
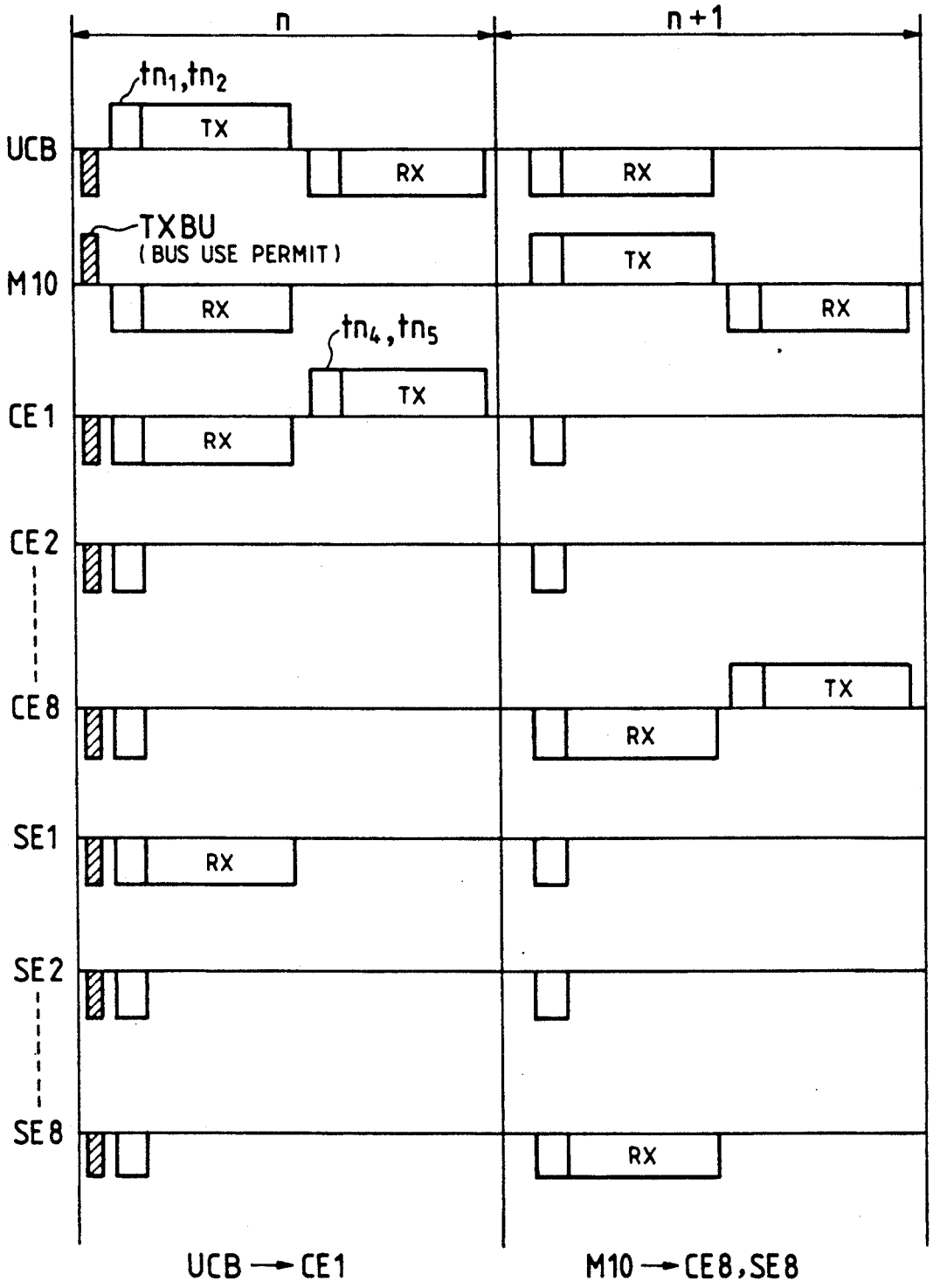
FIG. 18 shows the transmission timings.
Figure 19:
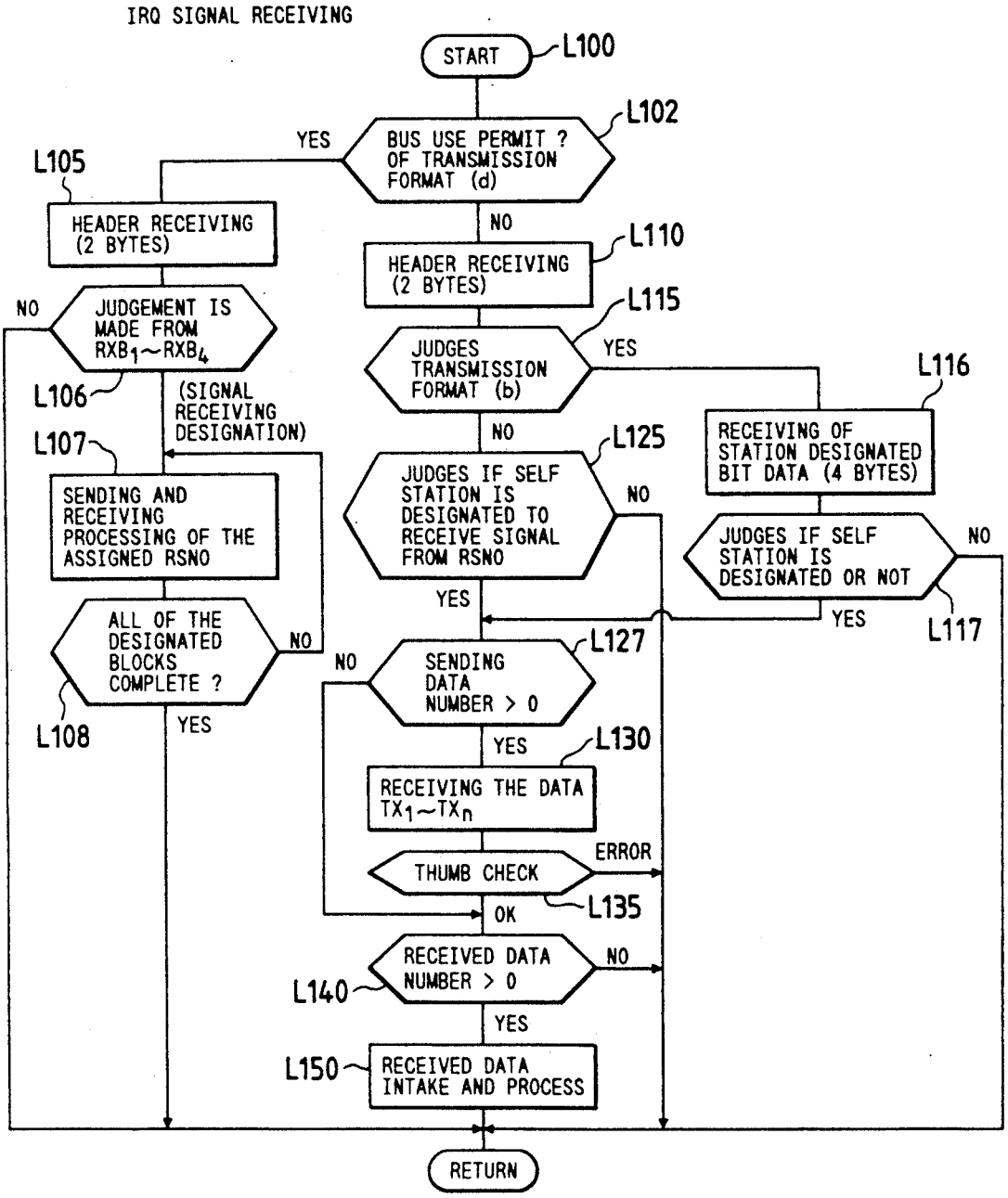
FIG. 19 is a flow-chart of data processing.

FIG. 18 is a time chart for network transmission, showing sending and receiving transmission between the user command board UCB and the first elevator control channel CE1 at the nth cycle of the time chart. It also shows the same transmission between the group control device M10 (supervision controller) based on the transmission block No. RSNO-9 and the eigth elevator cab control channel CE8 at the n+1 cycle of the chart.

Data transmission at the nth cycle based on the flow chart of FIG. 19 will now be discussed. First, when the data of bus use permit signal $CF issued from the representative station M10 following the method mentioned in the control table given as the first header TXHD in Table 1, each station receives it as the issuing of a receiving signal IRQ, classifies it by the transmission format of FIG. 16(*d*) (Step L102) and receives the bus use permit TXBU regarding it as a header. (Step L105)

TABLE 1

Control on No. 1 headers TXHD1.

| Header No. | Process (usage) | Transmission format |
|---|---|---|
| 1 $00 | Error | |
| 2 $01-$1F | Header for I/O terminal transmission | — |
| 3 $30-$6F | Header for network transmission | (a) |
| 4 $70-9F | Header for network transmission | (b) |
| 5 $AO-$AF | Header for I/O terminal inspection | — |

TABLE 1-continued

Control on No. 1 headers TXHD1.

| Header No. | Process (usage) | Transmission format |
|---|---|---|
| | process transmission | |
| 6 $BO-BF | Header for network terminal general transmission | (c) |
| 7 $C1-$DF | Network relay bus use permit | (d) |
| 8 $DF-$FF | Header for system test | — |

At Step L106 the signal is screened to see if it may be received. At Steps L107 and L108, the user command device UCB performs receiving transmission processing on a signal judged allowable (in Step 107), following the instruction of No. 7*b* bit and No. 6 bit of no block's table TRXMT (n,1) where the L108 loops until the transmission cycle n reaches 32.

Figure 21A:
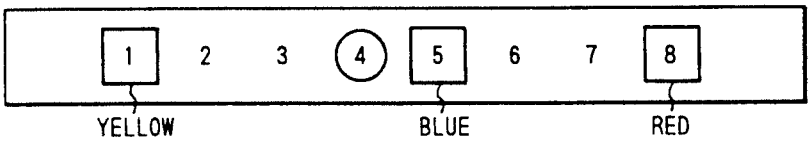
FIG. 21 shows a further information display.
Figure 21B:
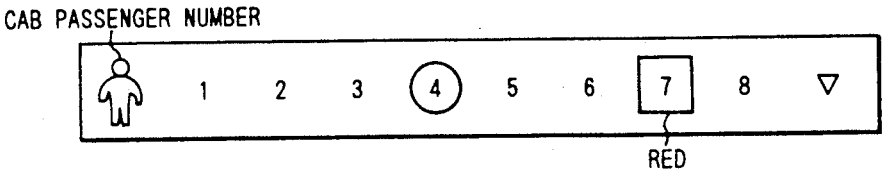

When the user command device UCB puts the format TX signal (sending signal) stated in FIG. 16(*a*) into both of transmission paths N10*a* and N10*b* toward first elevator cab control channel CE1, all the terminals receive header data HD1 of 2 bytes through the interruption processing (Step L110). There, the receiving terminal determines if the signal passes the header criterion provided in the transmission control table TRXMT (RSNO, 0) (Step L125). The IRQEN at the 3rd bit of TRXMT (RSNO, 1) judges if "1" or not for letting 2 operation control channels CE1 and SE1 check the number of TX data of TRXMT (RSNO, 2) and header addresses set in (4, 5) before each receiving process simultaneously. (Steps L127 and L150). Then the TX signal travels from the NO. 1 cab operation control channel CE1 to the user command device UCB. Other stations finish processing IRQ and go to inside processing. MAS station transmits the news acquired from TEL3 to information control system S101 taking it in the transmission format stated in FIG. 16(*b*). (Steps L115 to 117). The higher speed of the transission cycle and the more stable formulation of the overall network transmission path system can be achieved by simultaneously receving one data and making up of 1 cycle, by combining a certain time of TX and RX. The formulation makes troubleshooting the components of this system a lot easier, as stated in the Official Gazette Toku Gan Sho 53-15444 and Toku Gan Sho 51-23224. FIG. 21 represents an example where one unit of the hall information guidance device is used for service guidance. FIG. 21(*a*) shows the state before the hall call is made. FIG. 21(*b*) shows an example of the appearance displayed after the hall call is recorded. The figure is that for the floor. The block is the position of the elevator cabs. The round frame is the floor the cab is at. The figure shows the passenger number inside the cab. The mark shows the stored direction of elevator operation. The color in the small square defines the numbers of the cabs e.g. yellow for first cab, blue for the second and red for the third.

The above example offers the following features.

(1) The passengers waiting at cab doorway are less irritated because they have waited a long time for elevator service, since they know what is going on in the cabs at other floors.

(2) Reduction in the frequency of button pressing to call for cabs. There is no need to press button each time a person comes to the elevator. Everybody can see the button condition at the guidance board. The elevator can speed up and people feel better.

(3) The contents of the guidance information can be alternated any time required after it has once been set. The content can be changed and improved.

(4) Addition of an open-close position designation circuit (S120) in the information control device S101 of the user command device UCB makes the operator of the user command device UCB watch the door open-close condition in his monitor device.

This invention separates the channels of information control from that of elevator operation to make possible individualised guidance information content.

What is claimed is:

1. An elevator control system with at least one elevator cab capable of serving plural floors, comprising:

a common transmission path;

an operation signal control device including at least one elevator operation controller, corresponding to the at least one cab and coupled to the common transmission path, for generating elevator control signals for controlling the service operation of the at least one cab and for transmitting the generated control signals to the common transmission path, in which said one elevator operation controller has means for managing the use of the common transmission path; and an elevator information control device including at least one information controller, connected to the common transmission path, and responsive to signals present on the common transmission path, for generating various service information to be given to users waiting for service of the at least one cab at the respective floors on said basis of the signals.

2. An elevator control system with plural elevator cabs each capable of serving plural floors, comprising;

a common transmission path;

an operation signal control device including a plurality of elevator operation controllers, each corresponding to a respective one of the cabs and being coupled to the common transmission path, each of said elevator operation controllers including means for generating elevator control signals for controlling the service operation of a corresponding cab and for transmitting the generated signals to the common transmission path, and at least one of said elevator operation controllers having means for managing the use of the common transmission path; and an elevator information control device including at least one, but less than the number of the elevator operation controllers, information controller, connected to the common transmission path, responsive to signals present on the common transmission path for generating various service information to be given to users waiting for service of the cabs at the respective floors on the basis of said signals.

3. An elevator control system with plural elevator cabs each capable of serving plural floors, comprising;

a common transmission path;

an operation signal control device including a plurality of elevator operation controllers, each corresponding to a respective one of the cabs and being coupled to the common transmission path, each of said elevator operation controllers including means for generating elevator control signals for controlling the service operation of a corresponding cab and for transmitting the generated signals to the common transmission path, and a group controller, coupled to the common transmission path and provided with means for managing the use of the common transmission path, by transmitting signals for supervising the elevator operation controllers to the common transmission path; and an elevator information control device including at least one information controller, connected to the common transmission path, and responsive to signals present on the common transmission path, and for generating various service information to be given to users waiting for service of the cabs at the respective floors on the basis of said signals.

4. An elevator control system according to one of claims 1 to 3;

wherein there is further provided a maintenance device including at least one of a command device for selecting a rule of controlling the service operation of elevator cabs, a cab watching device for watching the state of the service operation of the cabs and a remote control device for communicating with a remote maintenance service center, all of which devices are to be coupled to the common transmission path and to transmit and receive necessary signals to and from the common transmission path.

5. An elevator control system according to one of claims 1 to 3;

wherein the elevator information control device includes an information input device, coupled to the common transmission path, for receiving information to be given to the users from an information center and for transmitting the received information to the common transmission path.

6. An elevator control system according to one of claims 1 to 3;

wherein each of the information controllers comprises an information control device, coupled to the common transmission path, for taking therein signals present on the common transmission path and for generating various service information to be given to users, and at least one hall information guidance device, provided at a selected one of the plural floors and coupled to the information control device through an information transmission path, for supplying said various service information to the users.

7. An elevator control system according to one of claims 1 to 3;

wherein each of the information controllers includes door position estimating means for estimating the degree of opening of a door of a cab stopping at a certain floor and for outputting the estimated degree of opening as one of the various service information to be supplied to the users.

8. An elevator control system according to claim 7; wherein the door position estimating means first calculates (1) a door opening speed on the basis of a continuing time of a door open instruction and a door open/close control mode signal and (2) a door closing speed on the basis of a continuing time of a door close instruction and the door open/close control mode signal, and when the opening or closing operation of a door is reversed, calculates (3) a speed of the reversing operation by correcting the door opening and closing speeds, according to an acceleration of the reversing operation obtained on the basis of a position of the door at which the reversing operation occurs and the door open/close control mode signal, and then, (4) generates a signal indicative of the degree of the opening of the door by integrating the thus obtained speeds.

9. An elevator control system according to one of claims 1 to 3;

wherein the various service information to be supplied to the users includes information about the state of whether or not a door open button provided in a cab is pushed.

10. An elevator system according to claim 3;

wherein each of the elevator operation controllers has a cab data table storing data concerning the operational state of a corresponding cab and a drive information data table storing data concerning the service state of the cab and transmits data stored in those data tables to the common transmission path, and the group controller has a control and instruction data table storing data concerning the group management of the service operation of the cabs and a service data table storing data indicating the service state of the cabs and transmits data stored in those data tables to the common transmission path.

11. An elevator control system according to claim 4; wherein the command device has a user command table storing data concerning the service condition and the service or control mode and a general information data table storing data concerning various service information other than the operation of the cabs, which can be supplied from external resources, and transmits data stored in those tables to the common transmission path.

12. An elevator control system according to claim 1;

wherein the common transmission path is of a bus type transmission medium.

13. An elevator control system according to claim 4;

wherein the operation signal control device includes the command device, which is coupled not only to the common transmission path, but also to the elevator operation controller through another transmission path.

14. A data transmission method for an elevator control system according to claim 1;

wherein data, which is transmitted to the common transmission path from at least one of the elevator operation controllers for a certain cab, the group controller and the command device, is simultaneously received by the elevator operation controllers for the remaining cabs and the information controllers.

* * * * *